US008061553B2

(12) United States Patent
McKeen

(10) Patent No.: US 8,061,553 B2
(45) Date of Patent: Nov. 22, 2011

(54) HINGED PACKAGING CONTAINER

(75) Inventor: John McKeen, Bridgenorth (CA)

(73) Assignee: Siemens Milltronics Process Instruments, Inc., Ontario (CA)

( * ) Notice: Subject to any disclaimer, the term of this patent is extended or adjusted under 35 U.S.C. 154(b) by 140 days.

(21) Appl. No.: 12/504,059

(22) Filed: Jul. 16, 2009

(65) Prior Publication Data

US 2010/0012673 A1 Jan. 21, 2010

(30) Foreign Application Priority Data

Jul. 16, 2008 (EP) ..... 08012868

(51) Int. Cl.
*B65D 43/16* (2006.01)
*B65D 51/04* (2006.01)

(52) U.S. Cl. ..... 220/817; 220/811; 220/836; 220/840

(58) Field of Classification Search ..... 220/840, 220/817, 818, 836, 4.23, 811
See application file for complete search history.

(56) References Cited

U.S. PATENT DOCUMENTS 2,605,926 A * 8/1952 Casey ..... 220/840
4,532,673 A * 8/1985 Kim ..... 16/233
4,985,962 A * 1/1991 Weber ..... 16/232
5,076,641 A * 12/1991 Lindberg ..... 297/188.19
5,210,906 A * 5/1993 Aihara et al. ..... 16/232
5,212,849 A * 5/1993 Aihara ..... 16/232
6,070,749 A * 6/2000 Joulia ..... 220/4.22
6,644,526 B2 * 11/2003 Pegorier ..... 224/539
6,761,278 B2 * 7/2004 Hyp et al. ..... 220/254.2
6,886,713 B1 * 5/2005 Scherrer ..... 220/817
7,439,444 B1 * 10/2008 Maltby et al. ..... 174/66
7,810,862 B2 * 10/2010 Smith ..... 296/24.34

FOREIGN PATENT DOCUMENTS

CA 2455668 A1 7/2004
EP 0570342 A1 11/1993

* cited by examiner

*Primary Examiner* — Mickey Yu
*Assistant Examiner* — Niki Eloshway

(57) ABSTRACT

A packaging container with a base and a cover hinged together is provided. Base and cover are hinged together by first and second cooperating formations formed integrally with the base and the cover. One of the first and second cooperating formations provide sockets and the other cooperating formations provide pin portions removably receivable in the sockets to be rotatable therein to allow the cover to be rotated relative to the base between an open position and a closed position. Number and locations of the first and second formations are such that one or more are used for hinging, while others provide structural support between the base and the cover when the container is in the closed position.

11 Claims, 4 Drawing Sheets

HINGED PACKAGING CONTAINER

CROSS REFERENCE TO RELATED APPLICATIONS

This application claims priority of European Patent Office Application No. 08012868.9 EP filed Jul. 16, 2008, which is incorporated by reference herein in its entirety.

FIELD OF INVENTION

This invention relates to a packaging enclosure with an integral hinge arrangement. The term "packaging enclosure" is used herein to denote an enclosure, containment or container for use in holding a product during transport and storage to afford ease of handling and protection from damage. The packaging enclosure of the present invention is principally intended for use with electronic equipment, in particular level measurement devices such as radar and ultrasonic signal emitting and control devices, but may equally be applicable to other products.

BACKGROUND OF INVENTION

Packaging enclosures in the form of a base and a hinged lid are well known. Conventionally, hinges are separate components comprising two base plates joined by a hinge pin, and are fastened to the parts to be hinged by screws or the like. This arrangement is relatively expensive and labour intensive.

It is also known to hinge two parts together by means of an integral hinge. For example, optical discs (CDs, DVDs) are sometimes supplied in a box having a base and lid of moulded plastic joined by an integrally moulded web along one edge. In arrangements of this nature, the base and lid can only be opened in one direction and cannot be separated. Moreover, the web constituting the hinge is necessarily thin, and is likely to rupture with repeated use.

SUMMARY OF INVENTION

The present invention provides a packaging container comprising a base and a cover hinged together by hinge means;

the hinge means comprising first and second cooperating formations formed integrally with the base and the cover respectively;

one of the first and second cooperating formations providing sockets and the other providing pin portions removably receivable in the sockets to be rotatable therein to allow the cover to be rotated relative to the base between an open position and a closed position;

and in which the number and location of said first and second formations is such that one or more may be used to form the hinge means while others provide structural support between the base and the cover when the container is in the closed position.

The invention thus provides a packaging container which is economical to make, simple to use, and robust.

In preferred embodiments of the invention, the base has at least two of said first formations adjacent a first edge, and at least two of said first formations adjacent a second edge oblique to the first edge; and the cover has at least two of said second formations adjacent a first edge, and at least two of said second formations adjacent a second edge parallel to the first edge.

This allows the container to be used in different orientations.

Preferably, the first and second formations cooperate for both rotational and translational movement. In one embodiment, this is achieved in that said one of the first and second formations comprises a pair of upstanding pillars having distal ends shaped to provide part-cylindrical surfaces, and said other of the first and second formations comprises a pair of upstanding webs having distal ends joined by a cylindrical portion; the cylindrical portion being receivable between the part-cylindrical surfaces for rotational movement; and the cylindrical portion being slidable between the upstanding pillars for translational movement.

This has the advantage that the packaging container can be closed in close contact with the object contained within.

The distal ends of a formation which is not in use as a hinge means is preferably arranged, when the container is in the closed position, to receive a part of the opposed cover or base. This acts to secure both parts together and also provides additional support.

Each of the base with the first formations and the cover with the second formations is formed as an integral plastics moulding. This is not only convenient and economical, but the material may be chosen to provide shock-absorbing properties.

BRIEF DESCRIPTION OF THE DRAWINGS

An embodiment of the present invention will now be described, by way of example only, with reference to the drawings, in which.

DETAILED DESCRIPTION OF INVENTION

Figure 1:
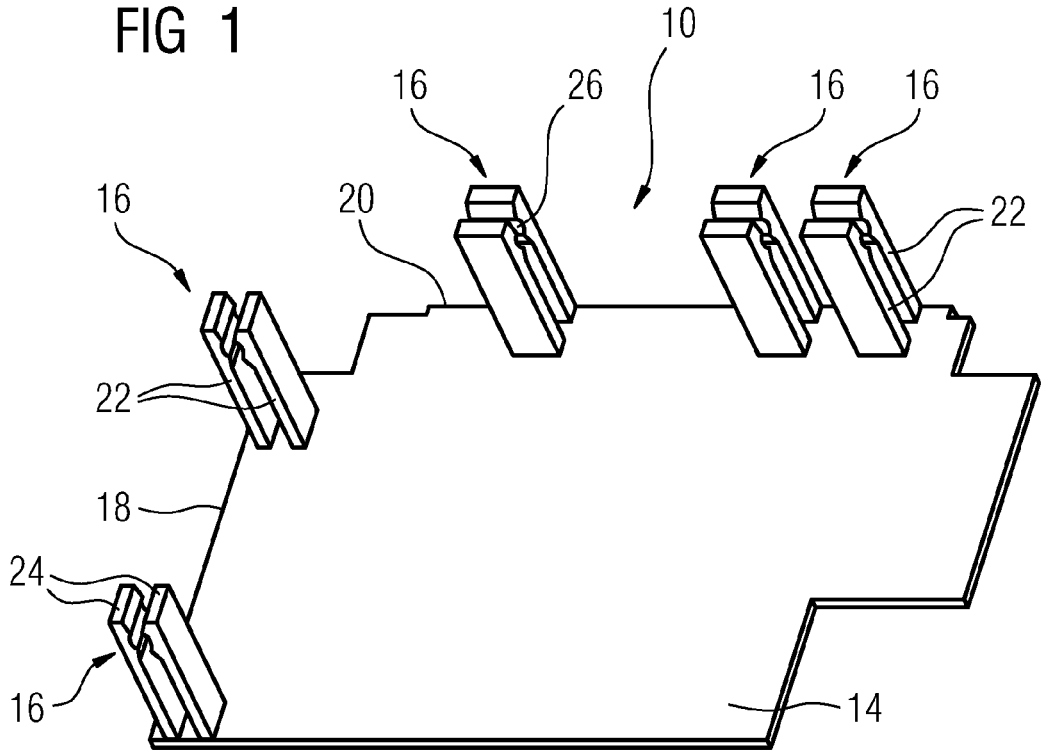
FIG. 1 is a perspective view of a base.

Referring to the drawings, the enclosure of the present embodiment comprises a base 10 and a cover 12.

Figure 2:
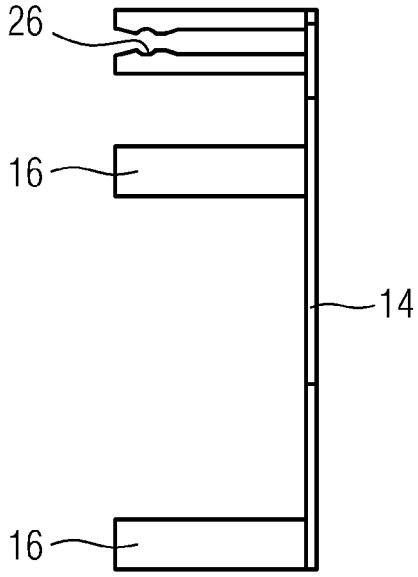
FIG. 2 is an end view of the base of FIG. 1.

The base 10 (see FIG. 1) has a plane portion 14 of a generally rectangular shape. Two pillar assemblies 16 extend from the plane of the portion 14 adjacent a first edge 18, and three similar pillar assemblies 16 extend in the same direction adjacent a second edge 20 transverse to the first edge 18. As best seen in FIG. 2, each of the pillar assemblies 16 comprises a pair of spaced, parallel pillars 22 each of which has an enlarged distal end 24 with facing faces formed to provide a part-cylindrical surface 26.

Figure 3:
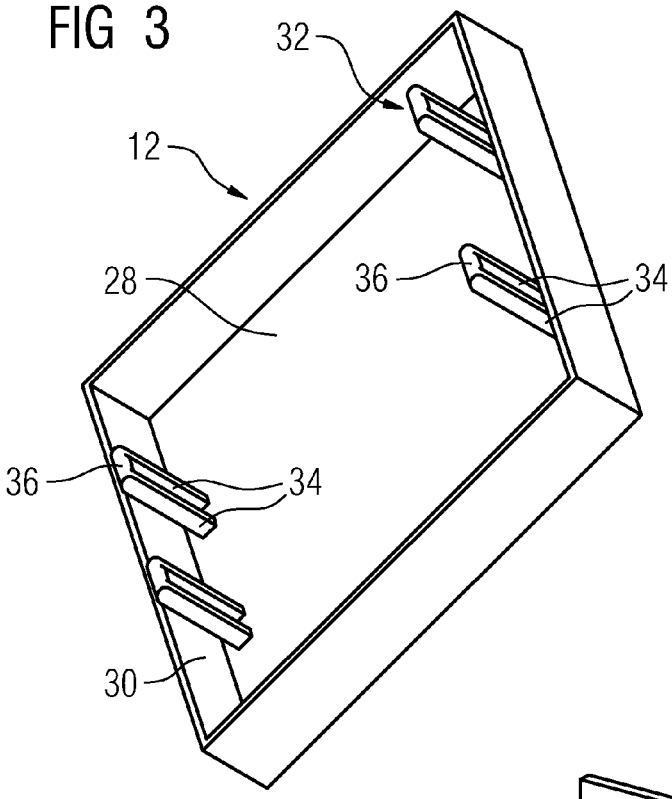
FIG. 3 is a perspective view of a lid or cover.
Figure 4:
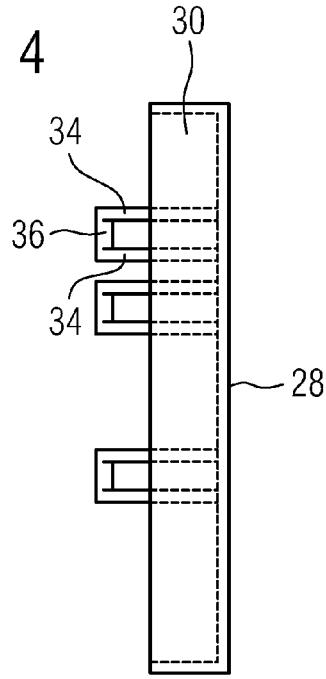
FIG. 4 is an end view of the cover of FIG. 3.

Referring particularly to FIG. 3, the cover 12 comprises a rectangular planar portion 28 enclosed by an upstanding flange portion 30. Within the flange portion 30 and adjacent opposite edges of the cover 12 are provided pin assemblies 32 each comprising upstanding webs 34 joined at their distal ends by a cylindrical portion 36 which acts, in assembled use, as a hinge pin.

The base 10 and the cover 12 are each formed integrally as a single plastic moulding. They can conveniently be formed by injection moulding of thermoplastic resins such as polycarbonate or acrylonitrile butadiene styrene (ABS).

Figure 5:
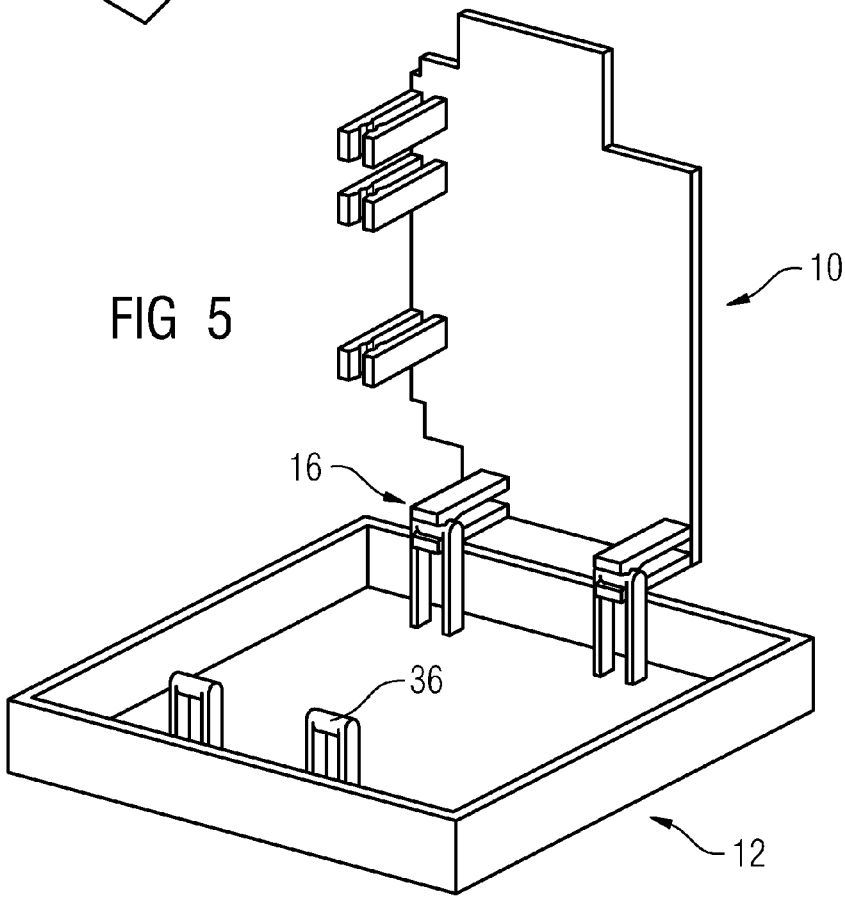
FIG. 5 is a perspective view of the base and cover hinged together and in an open position.
Figure 6:
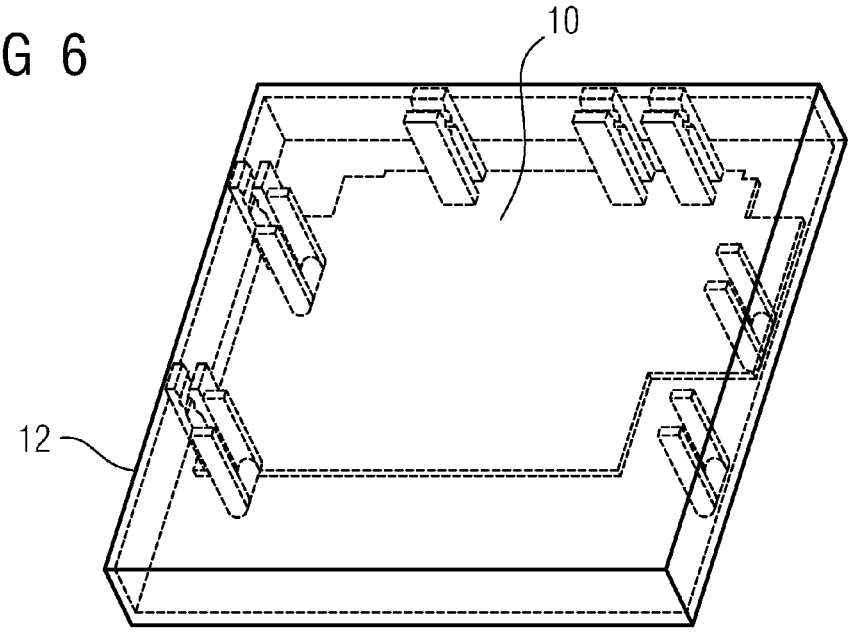
FIG. 6 is a similar view of the assembly in a closed position.
Figure 7:
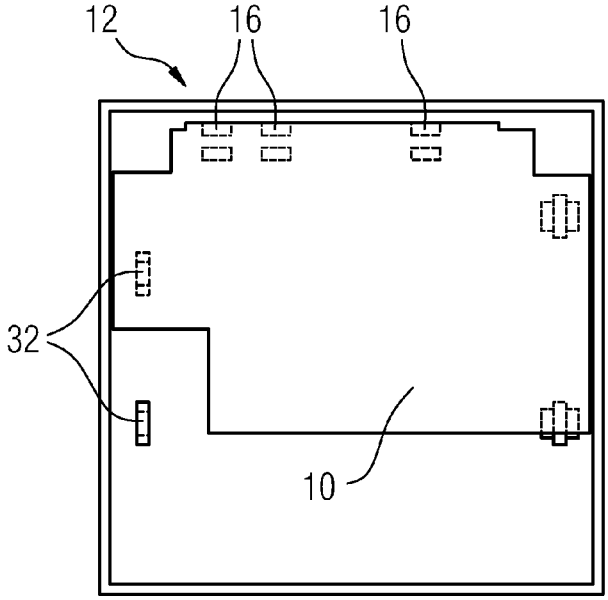
FIG. 7 is a plan view corresponding to FIG. 6.
Figure 8:
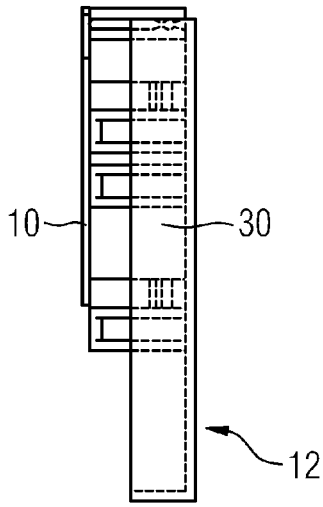
FIG. 8 is an end view corresponding to FIG. 6.
Figure 9:
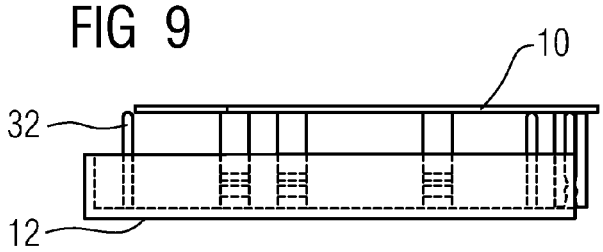
FIG. 9 is a side view corresponding to FIG. 6.

FIG. 5 shows the base 10 and cover 12 hinged together and in an open condition. The cylindrical portions 36 of two of the pin assemblies 32 at one side of the cover 12 engage with the part-cylindrical surfaces 26 of corresponding pillar assemblies 16. In this configuration, the cylindrical portions 36 act as hinge pins allowing relative rotation between the base 10 and the cover 12.

The cover 12 may be rotated to be parallel to the base 10, followed by movement towards the base 10 with the cylindrical portions 36 of the engaged pin assemblies 32 sliding pillars 22, to produce the closed configuration shown in FIGS. 6 to 9. It will be seen that in this configuration three of the pillar assemblies 16 engage about part of the flange portion 30 of the cover 12. These various engagements provide reinforcement against loads tending to compress the base 10 and cover 12 together; in addition, if the parts are made of a material having suitable resilience, a shock-absorbing function is provided.

The positioning of the pillar assemblies 16 and the pin assemblies 32 is such that the cover 12 may be arranged in a number of alternative positions with respect to the base 10. In the example shown in FIGS. 6 to 9 the cover 12 can be oriented in three different directions relative to the base 10, and only in these three directions. This feature can be used to achieve a number of purposes. For example, it can be arranged that the cover cannot be placed on the base with printing on the cover upside down. Also, it is possible to endure that any wiring connection on the enclosed device is at the bottom to prevent liquids or dust entering the device.

Figure 10:
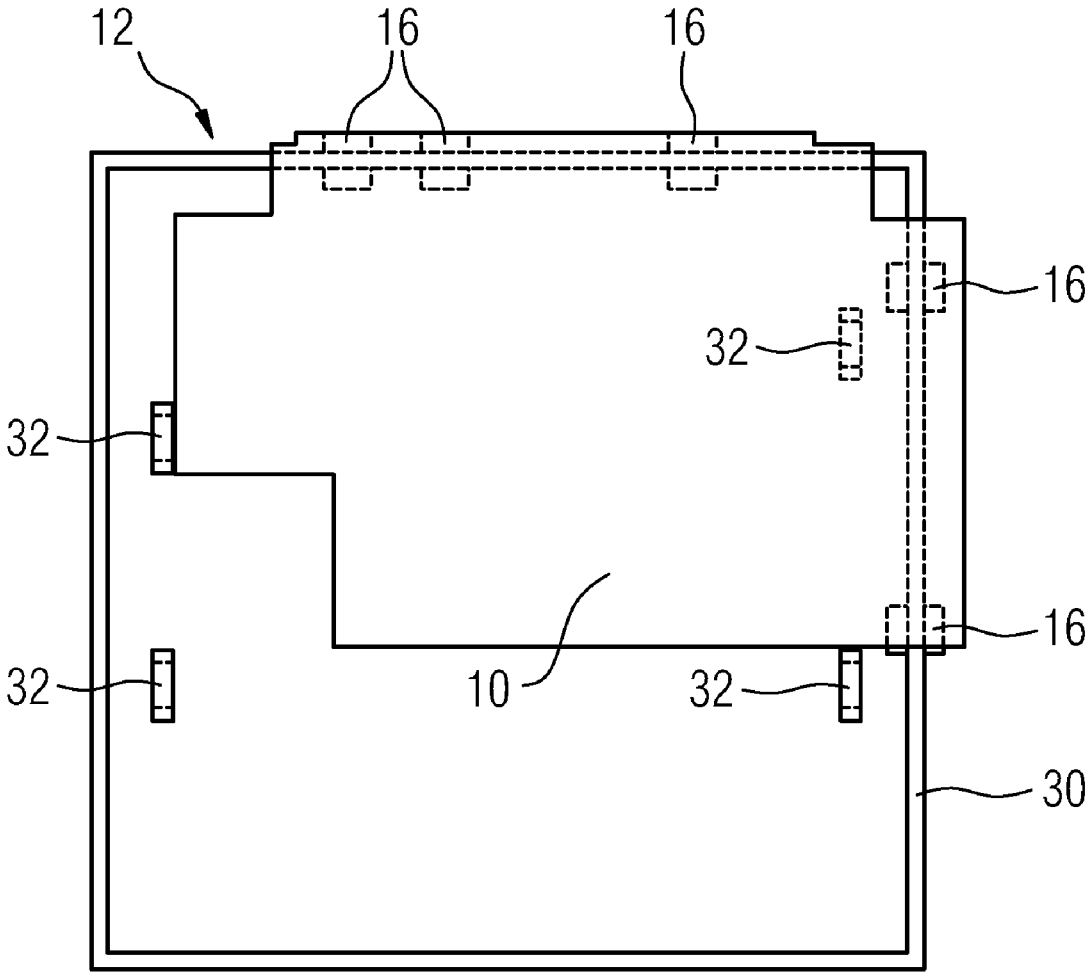
FIG. 10 is a plan view showing an alternative disposition of the base and cover in a closed position.

As seen in FIG. 10, in the present embodiment the cover can also be attached to the base in a non-hinged manner, with some of the pillar assemblies 16 gripping the flange portion 30.

The invention claimed is:

1. A packaging container, comprising:

a base and a cover hinged together;

first plurality of formations and a second plurality of formations configured to hinge the base and cover together, the first plurality of formations formed integrally with the base and the second plurality of formations formed integrally with the cover, the first and second plurality of formations providing sockets and pin portions, the pin portions removably receivable in the sockets to be rotatable therein to allow the cover to be rotated relative to the base between an open position and a closed position, wherein a number and locations of the first and second plurality of formations are such that a portion of the first plurality of formations cooperate selectively with a portion of the second plurality of formations to form a hinge while a remainder of the first plurality of formations and a remainder of the second plurality of formations provide structural support between the base and the cover without cooperating with each other when the container is in the closed position.

2. The packaging container as claimed in claim 1, wherein the base has at least two of the first plurality of formations adjacent a first edge, and at least two of the first plurality of formations adjacent a second edge oblique to the first edge, and the cover has at least two of the second plurality of formations adjacent a first edge, and at least two of the second plurality of formations adjacent a second edge parallel to the first edge.

3. The packaging container as claimed in claim 2, wherein the portion of the first plurality of formations and the portion of the second plurality of formations cooperate for both rotational and translational movement.

4. The packaging container as claimed in claim 3, wherein the portion of the first plurality of formations comprise a pair of upstanding pillars including distal ends shaped to provide part-cylindrical surfaces, and the one or more of the second formations comprise a pair of upstanding webs including distal ends joined by a cylindrical portion, the cylindrical portion being receivable between the part-cylindrical surfaces for rotational movement, and the cylindrical portion being slidable between the upstanding pillars for translational movement.

5. The packaging container as claimed in claim 4, wherein the distal ends of a formation, which is not in use for hinging when the container is in the closed position, receives a part of the opposed cover or base.

6. The packaging container as claimed in claim 2, wherein the base with the first plurality of formations and the cover with the second plurality of formations are formed as an integral plastics moulding.

7. The packaging container as claimed in claim 1, wherein the portion of the first plurality of formations and the portion of the second plurality of formations cooperate for both rotational and translational movement.

8. The packaging container as claimed in claim 7, wherein the portion of first plurality of formations comprise a pair of upstanding pillars including distal ends shaped to provide part-cylindrical surfaces, and the portion of the second plurality of formations comprise a pair of upstanding webs including distal ends joined by a cylindrical portion, the cylindrical portion being receivable between the part-cylindrical surfaces for rotational movement, and the cylindrical portion being slidable between the upstanding pillars for translational movement.

9. The packaging container as claimed in claim 8, wherein the distal ends of a formation, which is not in use for hinging when the container is in the closed position, receives a part of the opposed cover or base.

10. The packaging container as claimed in claim 7, wherein the base with the first plurality of formations and the cover with the second plurality of formations are formed as an integral plastics moulding.

11. The packaging container as claimed in claim 1, wherein the base with the first plurality of formations and the cover with the second, plurality of formations are formed as an integral plastics moulding.

* * * * *